US010112319B2

(12) United States Patent
Flamingo

(10) Patent No.: US 10,112,319 B2
(45) Date of Patent: Oct. 30, 2018

(54) BRICK CLAMP

(71) Applicant: Angelo LaMar Flamingo, Ottawa, IL (US)

(72) Inventor: Angelo LaMar Flamingo, Ottawa, IL (US)

( * ) Notice: Subject to any disclaimer, the term of this patent is extended or adjusted under 35 U.S.C. 154(b) by 76 days.

(21) Appl. No.: 15/340,708

(22) Filed: Nov. 1, 2016

(65) Prior Publication Data

US 2018/0117794 A1 May 3, 2018

(51) Int. Cl.
*B28D 7/04* (2006.01)

(52) U.S. Cl.
CPC ..... *B28D 7/04* (2013.01)

(58) Field of Classification Search
CPC .... B25B 3/00; B25B 5/00; B25B 5/12; B25B 5/14; B28D 7/04
USPC ..... 269/3, 6, 43, 143, 228, 249
See application file for complete search history.

(56) References Cited

U.S. PATENT DOCUMENTS 2,350,034 A * 5/1944 Herrington ..... B25B 5/12 269/164
2,538,149 A * 1/1951 Fannen ..... B29C 73/30 156/583.9
2,921,486 A * 1/1960 Burke ..... B25B 5/12 24/494
3,028,577 A * 4/1962 Strauss ..... H01R 11/22 269/228
3,971,552 A * 7/1976 Mayfield ..... B25B 5/06 269/228
5,346,194 A * 9/1994 Coffin, III ..... B25B 5/06 269/166
5,516,088 A * 5/1996 Coffin, III ..... B25B 5/06 269/166
9,316,240 B2 * 4/2016 Wen ..... F16B 2/10
9,889,543 B2 * 2/2018 Roesch ..... B25B 5/12
2002/0145297 A1 * 10/2002 Nickel ..... B25B 5/08 294/104
2010/0148414 A1 * 6/2010 Poole ..... B25B 5/12 269/228
2013/0199002 A1 * 8/2013 Wen ..... F16B 2/10 24/513
2017/0203412 A1 * 7/2017 Grobbel ..... B25B 5/12

* cited by examiner

*Primary Examiner* — Joshua E Rodden

(57) ABSTRACT

A clamp suitable for securing a plurality of bricks. The clamp can be adjusted to accommodate a wide range of brick, block or stone sizes. The clamp design is such that it can be easily taken to a work site and placed for ease of accessibility and operation. The bricks are placed on a cutting base and held by an upper arm. The upper arm is held open by springs and engaged via an engagement lever and a release lever. The engagement lever creates a clamping force between the upper arm and cutting base. Releasing the clamping force is accomplished by pressing down on the release lever. This pulls the engagement lever out of an over center locking position and frees the upper arm. This clamping and releasing process can be accomplished by an Individual's downward stomping force, allowing an operator to be hands free.

4 Claims, 3 Drawing Sheets

BRICK CLAMP

BACKGROUND

The present invention relates to a clamping devise, more over a clamping devise used specifically for securing one or more bricks during cutting operations.

A number of approaches are available to cut bricks. For example a Mason can score the brick then using a hammer or trawl, strike the brick until braking occurs. This process can take time and may not be as accurate as required, moreover material will be wasted because of the random nature of the brittle bricks.

Masonry saws are also available for cutting bricks. Typically these saws are hand held devises called partner saws. Other saws design can be electric bench type machines capable of cutting a small number of brick at one time but are large and cumbersome. The process can also consume time to measure and prep each brick for the cutting process. Further, when the most typical process of cutting is used i.e. the partner saw, each brick is usually held in place by hand or foot while performing the cutting operation. During this operation the saw can kick away from the brick, not to mention various chips and debris flying from the work area potentially creating a hazardous environment.

Accordingly there is a need for a device that is durable, light weight, can securely clamp a number of bricks at one time and reduces a potentially hazardous environment.

SUMMARY OF THE INVENTION

A clamp suitable for securing and can simultaneously accommodate a plurality "Tong" of brick. The clamp can be adjusted to accommodate a wide range of brick, block or stone sizes and design. The clamp design is such, that it can be easily taken to a work site and placed on the ground or raised work area for ease of accessibility and operation. The clamp will hold a full Tong of bricks taken directly from a manufactures cube via brick tongs. The bricks are placed on a cutting base and held in place by an upper arm. The upper arm is held open by springs and engaged via the engagement lever and support arm. This process creates a clamping force between the upper arm and cutting base.

Releasing the clamping force is accomplished by pressing down on the release lever. This process pulls the engagement lever out of it's over center locking position and frees the upper arm for opening. The opening process is accomplished by the upward force generated by the spring return.

The clamping and releasing process can be accomplished by an individual's downward stomping force, allowing the operator to be hands free.

DESCRIPTION OF VIEWS

The following detailed description of the preferred embodiments of the present invention can be best understood when read in conjunction with the following drawings, where like structure is indicated with like reference numbers.

PART LIST

Figure 1:
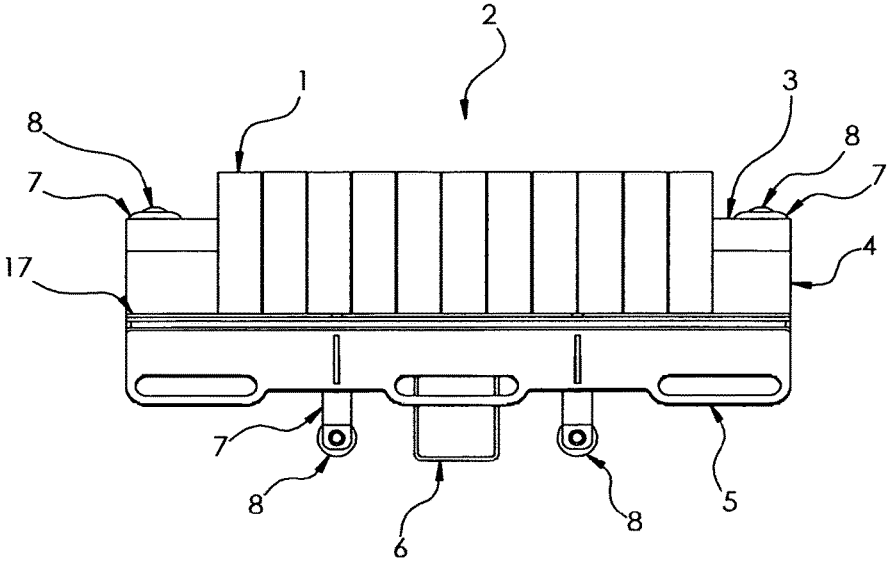
FIG. 1 is a top view of the clamp in its open state, a tong of bricks are resting on the cutting base.
Figure 2:
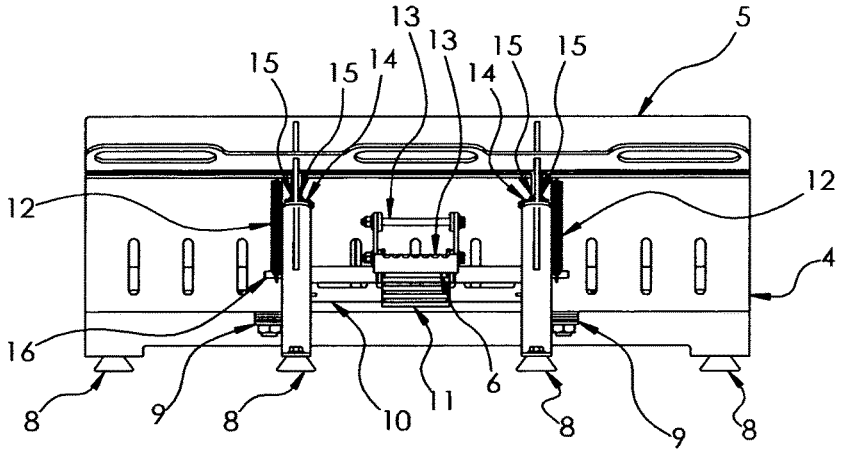
FIG. 2 is a back view of the clamp in its open state showing the position of upper arm and release lever.

1. Standard brick
2. Tong of Bricks
3. Cutting base Extension
4. Base Plate
5. Upper arm weldment
6. Engagement lever
7. Support frame weldment
8. Support frame foot
9. Base adjustment spacers
10. Lower engagement lever support
11. Release lever
12. Upper arm spring return
13. Lever arm pins
14. Attachment arm pins
15. Upper attachment arms
16. Lower engagement lever support shaft
17. Brick grip

DETAILED DESCRIPTION OF THE PREFERRED EMBODIMENTS

In the following detailed description of the preferred embodiments, reference is made to the accompanying drawings that form a part hereof, and in which Is shown by way of illustration, and not by way of limitation, specific preferred embodiments in which the invention may be practiced. It is to be understood that other embodiments may be utilized and that logical and mechanical changes may be made without departing from the spirit and scope of the present invention.

Figure 3:
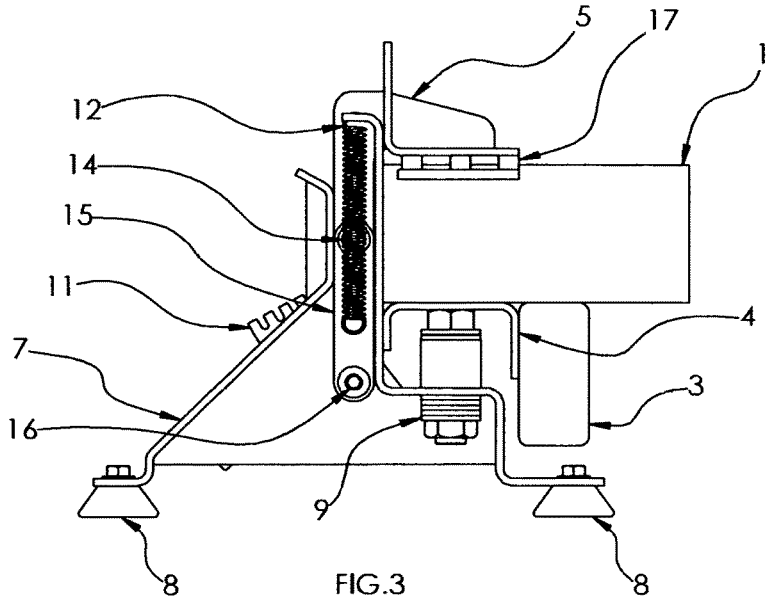
FIG. 3 is a side view of the clamp in its closed position the upper arm and cutting base can be observed.
Figure 4:
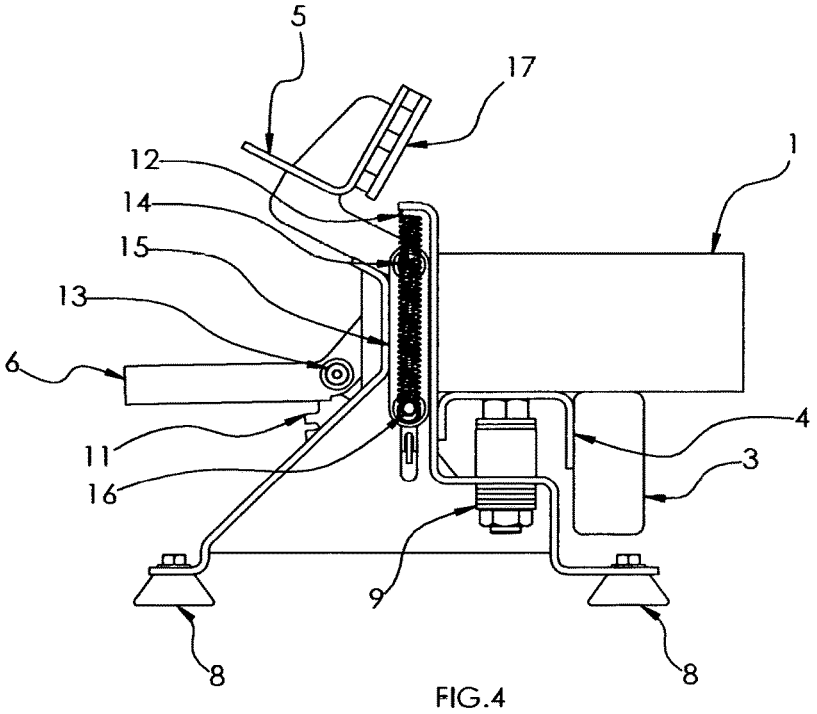
FIG. 4 is a side view similar to FIG. 3 but with the clamp in its open position.

Referring to FIGS. 1-6, a brick clamp according to an embodiment of the current invention is illustrated. As shown in FIG. 3-4, the clamp is best seated on the ground utilizing its support frame feet 8. The clamp is supported by its support frame weldment 7 creating a stable and horizontal work area. This work area is adjustable by base adjustment spacers 9. The base plate 4 in conjunction with the cutting base extension 3 creates a stable work surface. An embodiment of the design uses a wood material for extension 3. As seen in FIG. 4 the brick 1 can be easily placed on this work surface. This open work surface is also illustrated on FIG. 1 with the clamp in its open position an operator can easily place a tong of brick 2 onto the open work surface.

Figure 6:
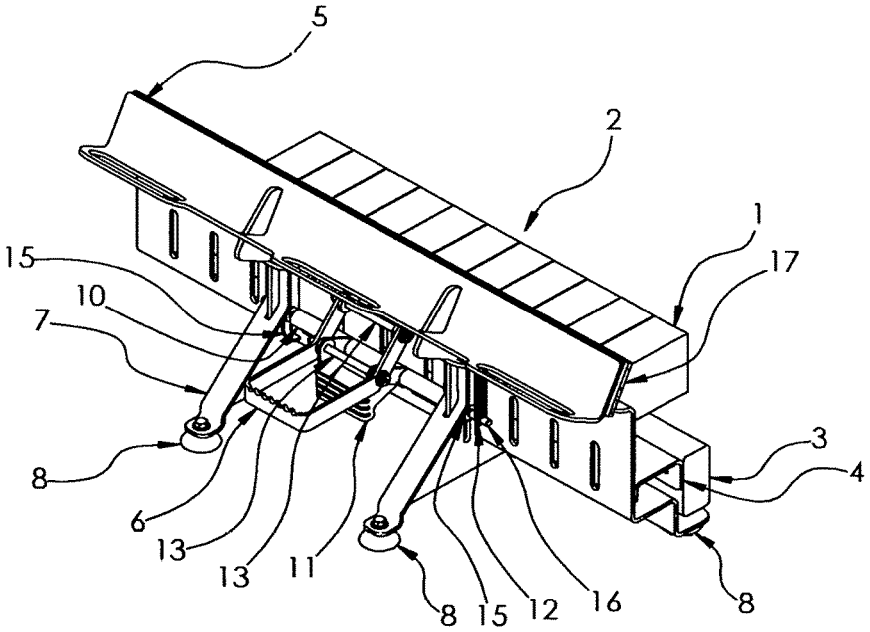
FIG. 6 is an orthogonal view similar to FIG. 5 but with the clamp in its open position.

Referring to FIG. 6 an operator using his foot will then push down on the engagement lever 6, in turn forcing the lower engagement lever support 10 to move down. This motion is transferred to the upper attachment arms 15 via the lower engagement lever support shaft 16. Upper attachment arms 15 are guided by the support frame weldment 7, in addition the clamping motion of the upper arm weldment 5 is also guided by the support frame weldment 7. Vertical movement of lower engagement lever support shaft 16 will also create tension on the upper arm spring return 12.

Figure 5:
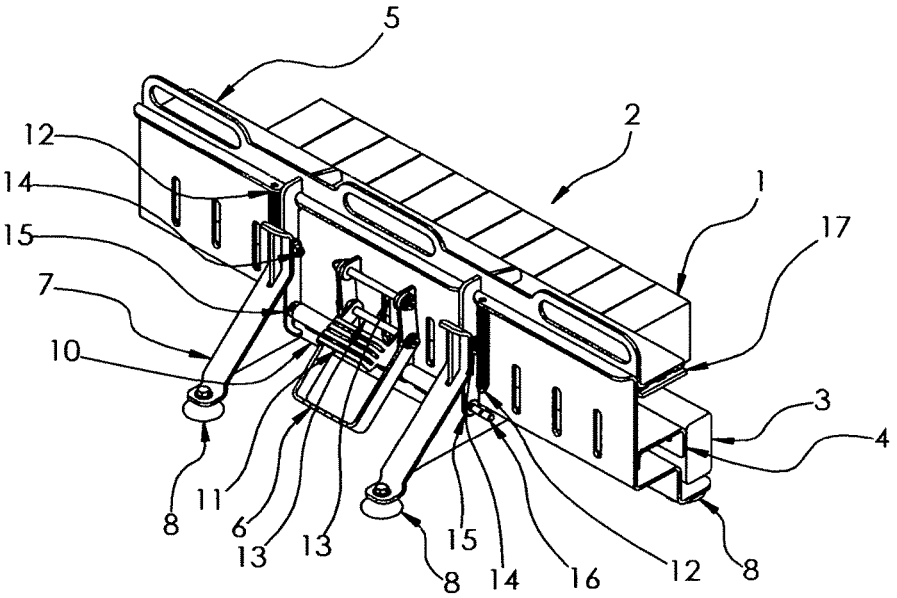
FIG. 5 is an orthogonal view of the clamp in its closed position showing a tong of brick in place.

Referring to FIG. 5 the clamping motion will continue until the engagement lever 6 has reached it's over center locking position illustrated in FIG. 5. The engagement lever 6, release lever 11, lower engagement lever support 10 are all held in place with respect to support frame weldment 7 by the lever arm pins 13. Furthermore, the upper arm weldment 5 is retained to the upper attachment arms 15 via attachment arm pins 14. At this time release lever 11 will rise above the engagement lever 6, refer to FIG. 3. Continuing on FIG. 3 one will notice that brick 1 or a tong of bricks 2 is locked between the base plate 4, cutting base extension 3 and the upper arm weldment 5. The clamp force is adjusted by an initial positioning of the base adjustment spacers 9. Adding in the retention of inconsistent brick design is the brick grip 17, one embodiment is to use a rubber material for the grip 17.

Referring to FIG. 5 the clamp can be released by the operator using his foot to push down on the release lever 11, this action pulls engagement lever 6 out of its over center locking position. The operator now simply needs to remove his foot from the engagement lever 6 and the brick clamp will then move to its open position as seen in FIG. 6 via the force retained in the upper arm spring return 12.

What is claimed is:

1. A clamp for masonry work comprising:

a base plate including a first workpiece bearing surface, wherein the base plate is configured to hold a plurality of work pieces directly onto the first bearing surface;

an upper arm weldment including a second workpiece bearing surface having an open and closed position with respect to the base plate, wherein when one of said workpieces is inserted between said base plate and said upper arm weldment and said upper arm weldment is in its said closed position, said one of said workpieces is clamped between said first and second workpiece bearing surfaces, said one of said workpieces is configured to be clamped in such a way as to not lose clamping force throughout a cutting and forming process;

a clamp operating device that is configured to transition the second workpiece bearing surface between said open and closed positions, wherein said closed position is defined by the first and second workpiece bearing surfaces being parallel and facing one another, and said open position defined by a first spacing of the first and second workpiece bearing surfaces in the open position being greater than a second spacing between the first and second workpiece bearing surfaces in the closed position;

the clamp operating device has an over center locking means comprising: an engagement lever that controls and moves said second workpiece bearing surface from the open to the closed position: a release lever that controls and moves said second workpiece bearing surface from the closed to the open position, and a spring return that assists in returning said upper arm weldment to said open position from said closed position.

2. A clamp according to claim 1, wherein: said engagement lever is configured to be operated by a stepping or stomping force of an operator; said release lever configured to be operated by the stepping or stomping force of the operator.

3. A clamp according to claim 2, wherein: said engagement lever is configured to be operated by a force other than the stepping or stomping force of the operator; said release lever configured to be operated by a force other than the stepping or stomping force of the operator.

4. A clamp according to claim 2 wherein: the clamp is configured to be portable such that an individual worker can transport said clamp to a job site and said clamp is configured to be operated by said individual worker.

* * * * *